United States Patent [19]

Schraff et al.

[11] Patent Number: 4,640,202

[45] Date of Patent: Feb. 3, 1987

[54] READILY REPAIRABLE AND LIGHTWEIGHT COVER FOR A HEATED VESSEL

[75] Inventors: Raymond J. Schraff, Cleveland; Thomas M. Miller, North Olmsted; Nicholas Labas, Solon, all of Ohio

[73] Assignee: ELTECH Systems Corporation, Boca Raton, Fla.

[21] Appl. No.: 716,029

[22] Filed: Mar. 26, 1985

Related U.S. Application Data

[63] Continuation-in-part of Ser. No. 635,441, Jul. 30, 1984, Pat. No. 4,524,702.

[51] Int. Cl.[4] ..... F23M 5/00

[52] U.S. Cl. ..... 110/336; 220/215; 432/250; 52/506; 266/280

[58] Field of Search ..... 110/331, 336, 173 A, 110/332; 432/248, 250; 52/506; 266/280; 220/215

[56] References Cited

U.S. PATENT DOCUMENTS

| | | | |
|---|---|---|---|
| 3,853,077 | 12/1974 | Malovich | 110/173 |
| 3,854,262 | 12/1974 | Brady | 52/404 |
| 4,287,839 | 9/1981 | Severin et al. | 110/336 |
| 4,291,514 | 9/1981 | Harvey | 110/336 |
| 4,318,259 | 3/1982 | Verheyden | 110/336 |
| 4,411,621 | 10/1983 | Miller | 432/247 |
| 4,440,099 | 4/1984 | Brachet | 110/336 |
| 4,449,345 | 5/1984 | Hounsel et al. | 52/506 |
| 4,463,689 | 8/1984 | James | 110/336 |
| 4,494,295 | 1/1985 | Herring | 110/336 |
| 4,523,531 | 6/1985 | Bishara | 110/336 |

FOREIGN PATENT DOCUMENTS

| | | |
|---|---|---|
| 0013039 | 12/1979 | European Pat. Off. . |
| 2323117 | 4/1977 | France . |
| 2112119 | 6/1983 | United Kingdom . |

*Primary Examiner*—Henry C. Yuen
*Attorney, Agent, or Firm*—John J. Freer

[57] ABSTRACT

A lightweight cover provides heat insulation for a heated vessel such as a soaking pit. The cover can be readily assembled in a manner providing for ease of repair plus simplicity of maintenance. The cover has a pair of opposing frame members with ceramic fiber insulation positioned therebetween. The insulation is secured in movable engagement such as a free-floating and swinging engagement. In this mode, compression can be exerted against the insulation to most desirably reduce heat loss otherwise caused by heat induced ceramic fiber shrinkage. Moreover, with this structure a ceramic fiber heat seal can be achieved around edges of the soaking pit.

12 Claims, 8 Drawing Figures

READILY REPAIRABLE AND LIGHTWEIGHT COVER FOR A HEATED VESSEL

CROSS-REFERENCE TO RELATED APPLICATION

This application is a continuation-in part of U.S. patent application Ser. No. 635,441 filed July 30, 1984 and now U.S. Pat. No. 4,524,702.

BACKGROUND OF THE INVENTION

It has been traditional to line heated vessels such as soaking pit covers with dense fire brick linings. Such linings however, are sensitive to thermal shock which can severely limit the lifetime of the lining. It has therefore been more recently proposed to line soaking pit covers with fibrous refractory insulating materials. For example, it has been proposed in U.S. Pat. No. 3,854,262 to arrange strips of ceramic fiber blankets into compressed panels by means of metallic parts buried in the blanket material exerting compressive pressure on the material. At the portion of the panel away from this internally exerted compression, the fibrous blanket strips will tend to "blouse", so that on the furnace side of the soaking pit lid there will be a continuous protection of insulating material. Or the strips of fibrous insulation can be impaled on spikes, with the spikes projecting outwardly from under a top plate, on metal support members, of a soaking pit cover. Such structure has been shown and discussed in U.S. Pat. No. 3,853,077.

As opposed to such strips of fibrous blanket material, it has also been proposed to employ a series of interlocking U-shaped mats. By the interlocking of the mats of such shape, heat path leakage can be reduced or even eliminated. Such leakage across the more traditional fire brick linings tended to fracture the refractory brick and/or the mortared joints between the brick. The utility of such a structure for soaking pit covers has been discussed in U.S. Pat. No. 4,411,621. Therein, it has been more specifically shown to support the fibrous mats by securing them to a metal mesh cover, such as by wire ties.

Blocks of ceramic fiber blankets, having a somewhat squared off face, have also been used in soaking pit covers. These blocks, as shown for example in U.S. Pat. No. 4,449,345, have internal support structure and an external clip for fastening. Such clip may be fastened on to a mating element attached to a metal mesh cover. To compensate for fiber shrinkage during cover use, loose repair fiber can be manually wedged between blocks, from the hot face, while the cover is not in service.

More recently, in U.S. patent application Ser. No. 602,197, it has been proposed that a cover such as for a furnace or soaking pit contain a series of U-shaped blankets in side-by-side relationship. These blankets serve as the principle covering elements, and may be supported by hangers slideably engaging a support bar. By means of this structure, compression exerted against an end blanket can be transmitted across the covering of the blanket elements by virtue of the sliding hanger arrangement. Moreover, the hangers can be sized to provide for limiting the maximum degree of sliding, or compression, of the covering blankets.

It would, however, be most desirable to assemble a cover structure that overcomes the disadvantages of fire brick linings and offers the advantages of ceramic fiber insulation, while commensurately providing a structure not only of great ease of assembly, but also ease of repair. It would also be most desirable that such structure have the facility of blanket compression, without inducing deleterious degradation of fiber blanket integrity during compression. It would furthermore be advantageous if such cover structure was most lightweight and could be readily placed upon and removed from the soaking pit.

SUMMARY OF THE INVENTION

Such objects have now been accomplished by means of the present invention. A lightweight cover is now provided which features ease of assembly. Moreover, the cover is particularly adapted for ease of disassembly and repair. The cover is lightweight, yet durable. By being compressible, it can withstand elevated vessel pressures, while achieving a cooler cold face for enhanced insulation. The cover can accommodate uneven soaking pit surfaces, in part through twist flexing of the cover. Yet the cover is a single, integrated unit which can provide a ceramic fiber insulation seal around all edges of a soaking pit. The cover further can lend itself to repair, e.g., as a soaking pit cover, even while the cover is in use, without taking the cover out of service.

The present invention is thus particularly directed to a lightweight insulation cover structure for retaining heat in a heated vessel such as in a soaking pit, which cover structure has a ceramic fiber insulation hot face under a supporting frame having a pair of outer frame members, the frame members being spaced apart in opposing relationship one from the other, and with the ceramic fiber insulation being positioned between the pair of opposing frame members by linking means connecting the insulation with the supporting frame in upwardly moveable and at least substantially swinging engagement, whereby the insulation is free-floating under the frame.

Another important aspect of the present invention is directed to the positioning of frame members to permit twist flexing of the supporting frame. A still further important aspect of the present invention includes adjustable insulation compression means which, when set, can be maintained in place in locked position. Additional aspects of the present invention, all of which have been more fully set out in the claims, include an innovative fiber insulation module structure, a novel hanger for use in such structure, as well as innovative support leg structure for protecting insulation of cover structures such as during cover transport or storage.

DESCRIPTION OF THE PREFERRED EMBODIMENTS

Ceramic fiber insulation will be useful for purposes of the present invention so long as it is available in some form-stable condition, i.e., as opposed to merely loose fibers. To provide form-stable condition, it can be expected that individual fibers will have been brought together in matrix form, such as by felting or weaving operation or the like. When in such form, the insulation can be supplied in units. For convenience, individual ceramic fiber insulating units will generally be referred to herein as "blankets", but it is to be understood that the words "batts" and "mats" may also be used to refer to such units. By use of the term ceramic fiber "module" or the like, reference is being made to a blanket unit plus associated blanket support and hanging elements, i.e., a blanket unit and associated "hardware". In the module more than one blanket may be present, e.g., by stitching together adjacent blankets or by interengaging such blankets by inner support means.

The heated vessel for which the cover will find use can be generally any such vessel wherein a planar, or at least substantially planar, cover will be useful, e.g., as with a soaking pit. The vessel may be heated by means such as forced air convection heating as well as by containing hot solid metal, e.g., one or more steel ingots. In general, the ceramic fiber insulation filler in the cover will be useful at interior cover temperatures on the order of 2500° F. (1370° C.) or even greater. Thus the cover is contemplated for use with furnaces and tundishes, or as ladle covers and the like, where the cover can withstand such temperatures as well as the positive pressures associated with heating means, e.g., as with forced air heating means. In commercial practice, use of the invention for the covering of vessels usually containing molten aluminum or iron, including steel such as stainless steel, is most contemplated. Moreover, the cover will necessarily be most serviceable over vessels such as soaking pits, wherein a fiber seal around the edge can be desirable and elevation adjustment members of the covers may be useful. Thus, reference herein will usually be made to a cover for a soaking pit, although it is to be understood that such references will be most always only made for convenience and not in a manner limiting the invention.

Figure 1:
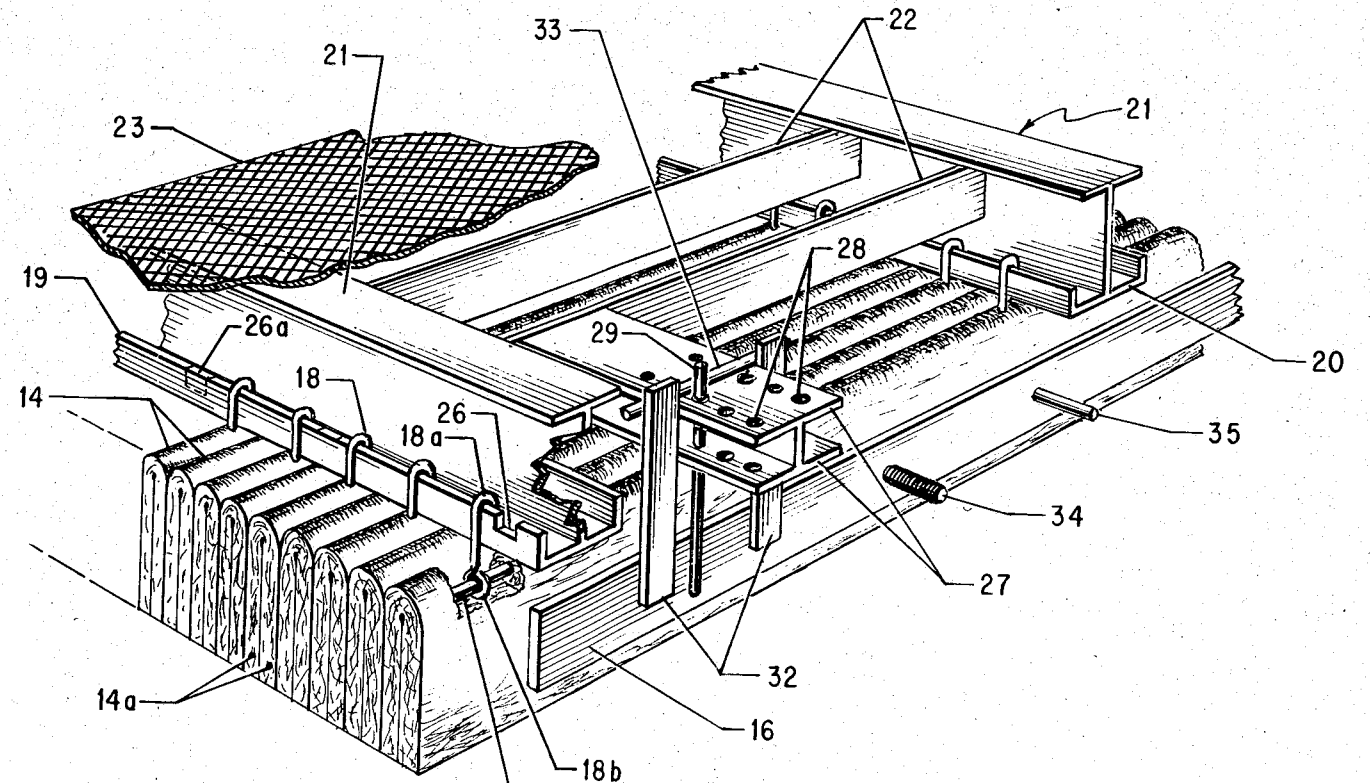
FIG. 1 is a perspective view in partial section of a corner portion of a vessel cover with outer frame member removed from the foreground.

Referring now in greater detail to the drawings, FIG. 1 is a perspective view in partial section of a corner portion of a soaking pit cover, with the outer frame member, not shown, removed from the foreground thereby exposing a compression plate 16 which abuts up against a series of U-shaped cover blankets 14. Each of the U-shaped cover blankets 14 has a pair of depending blanket legs **14*a*. A reinforcing bar 17 is retained within the fold of each U-shaped cover blanket 14. To each reinforcing bar 17 there are attached wire hangers 18 which pierce through the cover blanket 14 and terminate upwardly in a wire hook 18*a*. Each wire hanger 18 has a tail section 18*b* within the blanket 14, which tail section 18*b* loops around the reinforcing bar 17. Each wire hook 18*a* rides over an upright edge 19 of a bottom flange 20 of an insulation support member 21. By means of this hooking arrangement, the blankets 14 can move into snug side-by side relationship under force exerted from the compression plate 16. Also, the blankets 14 and hooks 18*a* can move upwardly when the blankets 14 are at rest, e.g., on the edge of a soaking pit, not shown. Affixed between the support members 21 are stiffeners 22 which lend reinforcement to the support members 21. Overhead, a readily removable metal mesh 23 covers the stiffeners 22**.

The upright edge 19 of the bottom flange 20 of the support member 21 contains an end splice 26 as well as other, filled, splice sections **26*a*. The end splice 26 provides an aperture in the upright edge 19 whereby the wire hooks 18*a* of the hangers 18 can be inserted in, or removed from, the upright edge 19. The filled splice sections 26*a* are similarly useful, e.g., during construction of the cover assembly. Extending from the support member 21 and from the stiffener 22 nearest the compression plate 16, are a pair of positioning plates 27 spaced apart by a plate spacer 31. Each positioning plate 27 contains a multitude of apertures 28. When the compression plate 16 is compressed into position against the cover blankets 14, a locking pin 29 is inserted in the apertures 28 nearest the outer face of the compression plate 16 whereby the lower section of the locking pin 29 abuts firmly against the outer surface of the compression plate 16 and maintains the compression plate 16** in locked position. Such locking arrangement assures maintenance of at least the locking position compression regardless of involvement from the compression actuating means, not shown.

Astride the positioning plates 27 and affixed to the compression plate 16 are upwardly projecting support legs 32. These legs 32 are interconnected at their top by a support bar 33 which rests on the upper surface of the top positioning plate 27. By such means, the compression plate 16 is supported as well as having freedom to move, when compression is exerted or relaxed, by means of the support bar 33 movement across the upper surface of the top positioning plate 27. Also, the compression plate 16 has threaded pins 34 through which pressure is exerted on the compression plate, by means not shown. Furthermore, the compression plate 16 may contain guide pins 35 which project through holes in the adjacent frame member, not shown, and guide as well as support the compression plate 16. Such guide pins 35 are optional, especially where a compression plate 16 is supported by a support bar 33 atop a pair of support legs 32.

Figure 2:
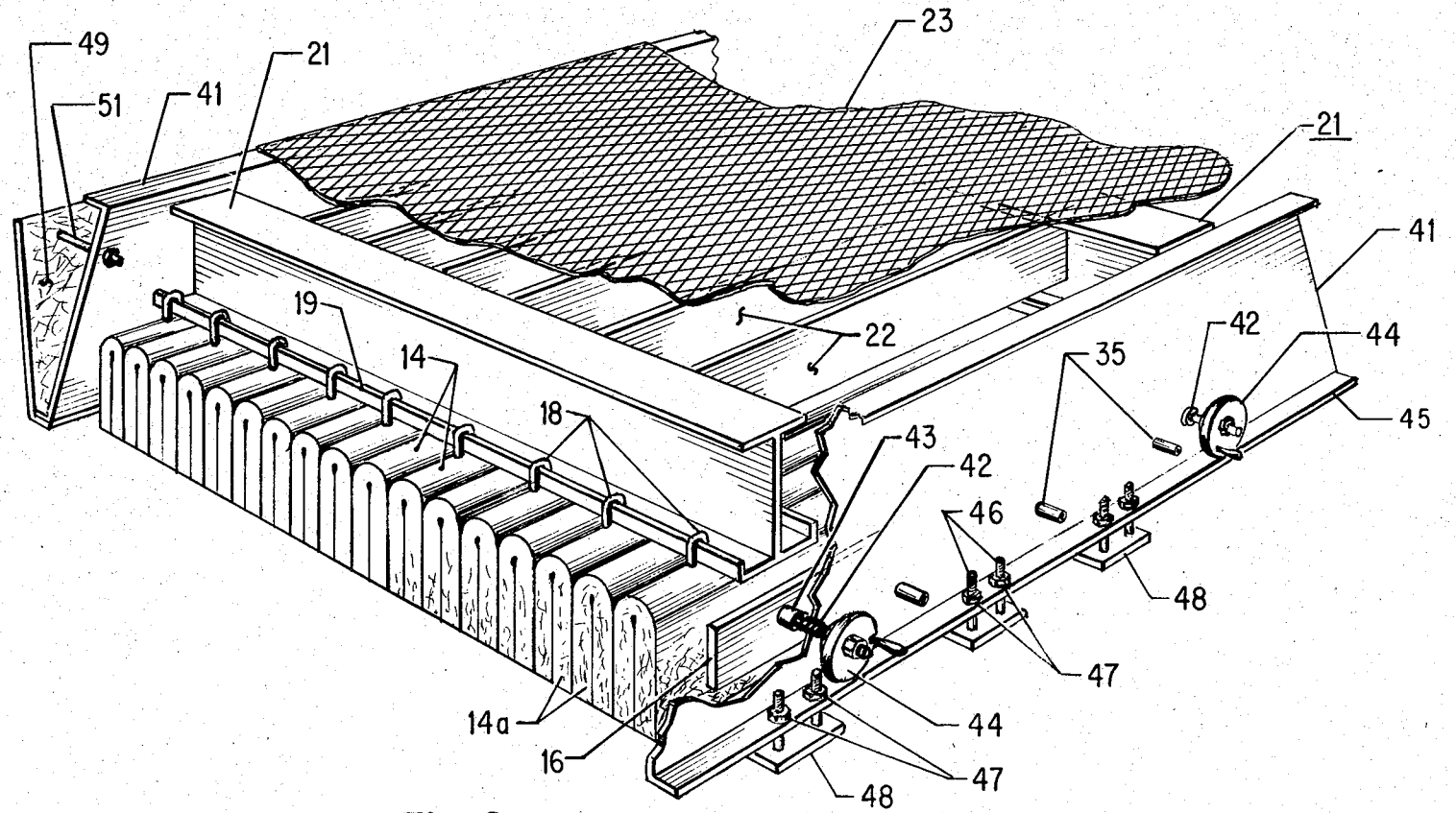
FIG. 2 is a perspective, elevational view, with frame member in the foreground in partial section, of a vessel cover especially useful as a soaking pit cover.

Referring now more particularly to FIG. 2, a series of cover blankets 14 are again depicted depending by wire hangers 18 from support members 21. The support members 21 are fastened, as by welding, at each end to an outer frame member 41 typically used for support when the cover is in use, e.g., for resting on the ground or a floor. Behind the outer frame member 41, as shown by partial section, is a compression plate 16, abutting against a depending leg **14*a* of a cover blanket 14, the folded bankets 14 having folds oriented in parallel to the outer frame member 41. Compression from the compression plate 16 is thereby exerted in a direction transverse to the outer frame member 41 and transverse to the folds of the blankets 14. Protruding from the compression plate 16 and through the frame member 41 are the guide pins 35. Also projecting from the compression plate 16 are threaded rods 42 that likewise project, by means of threaded apertures, through the frame member 41. The threaded rods 42 abut against the compression plate 16 within collars 43. By means of a turn plate 44, the threaded rods 42 can be screwed through the threaded sections of the frame member 41 and thereby exert pressure against the compression plate 16**.

Through threaded holes in the bottom flange 45 of the frame member 41 there are inserted threaded posts 46 which protrude through threaded fasteners 47 and terminate downwardly in a foot 48. The combination of the foot 48 with the threaded posts 46 provides for elevation adjustment of the frame member 41. Atop the stiffeners 22, is a metal mesh cover 23, shown in partial section. At one end, the frame member 41 is eguipped with a heat shield 49 connected to its frame member 41 by fastening means 51.

Figure 3:
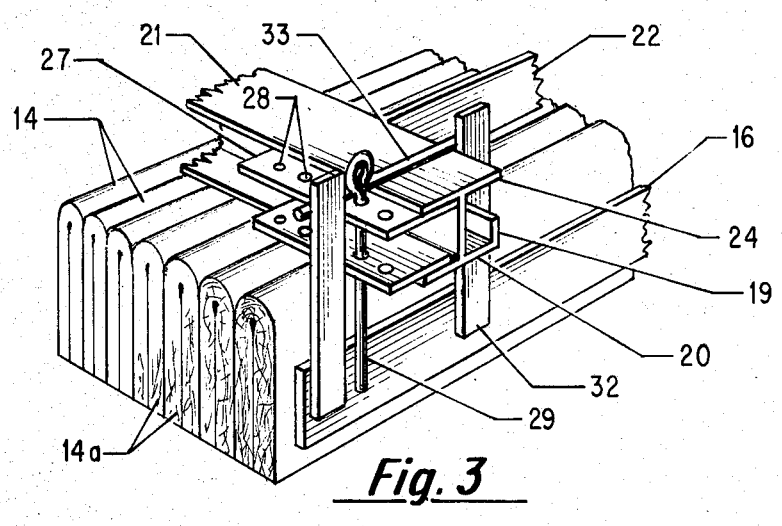
FIG. 3 is a perspective view of a corner portion only for a vessel cover with outer frame member removed.

Referring now more particularly to FIG. 3, a series of U-shaped cover blankets 14 each having a pair of depending blanket legs **14*a* are again supported from a support member 21. The support member 21 has one upright edge 19 extending from its bottom flange 20. The blankets 14 are linked by hangers, not shown, to the single upright edge 19 It is preferred to have the upright edge 19 positioned as shown, so that the hangers, not shown, are more protected from any heat escaping along the outer edge of the cover blankets 14. As in FIG. 2, the cover assembly of FIG. 3 likewise is provided with stiffeners 22**.

At the end of the support member 21 near the frame member, not shown, and at the outer edge of both the bottom flange 20 and the top flange 24, as well as and nearest the outer edge of the cover blankets 14, are positioning plates 27 containing a multitude of apertures 28. When the compression plate 16 is compressed into position against the cover blankets 14, a locking pin 29 is inserted in the apertures 28 nearest the outer face of the compression plate 16 whereby the lower section of the locking pin 29 abuts firmly against the outer surface of the compression plate 16 and maintains the plate 16 in locked position.

Astride the positioning plates 27 are support legs 32 affixed to the compression plate 16. These legs 32 are interconnected at their top by a support bar 33 which rests atop the upper surface of the top positioning plate 27 plus top flange 24. By this assembly, the compression plate 16 is supported as well as having freedom to move, when compression is exerted or relaxed, this freedom being supplied by the movement of the support bar 33 across the upper surface of the upper positioning plate 27 and top flange 24.

Figure 4:
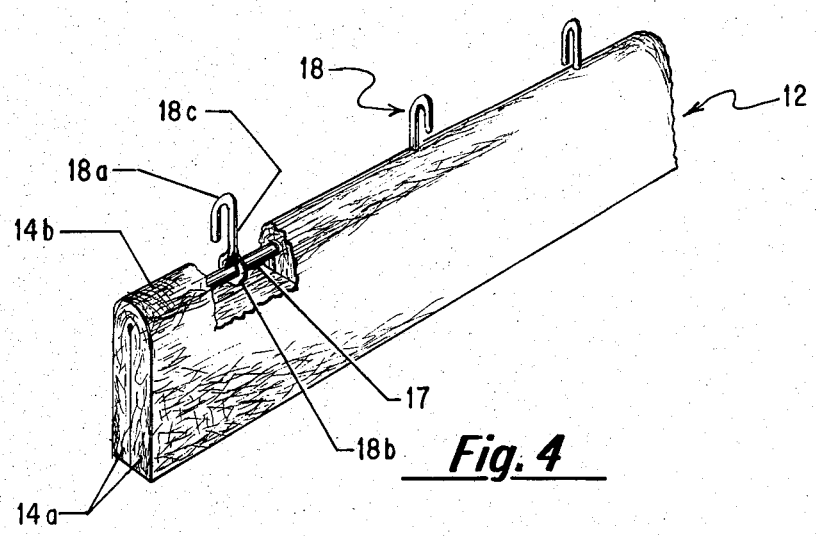
FIG. 4 is a perspective view, in partial section, of a ceramic fiber insulation module.

In FIG. 4 there is depicted an elongated insulation module shown generally at 12. The module comprises a U-shaped cover blanket 14. The blanket has a pair of depending blanket legs **14*a* and an upper bridging portion 14*b*. Nestled within the fold of the blanket 14 at the bridging portion 14*b* and extending along virtually the length of the blanket 14, but not fully to the end thereof, is a reinforcing rod or bar 17. Keeping the reinforcing bar 17 from reaching the end of the blanket 14 allows for some flexibility at such end, as in brushing contact during transportation. Spaced along the reinforcing bar 17, and protruding through the bridging portion 14*b* of the blanket 14, are wire hangers 18. Although three hangers 18 are shown, it is understood that more, e.g., as many as six or eight or more, may be useful. Each hanger 18 has a circular eye 18*b*, an upper wire hook 18*a* and a wire mid-section 18*c* between the lower eye 18*b* and upper hook 18*a*. As depicted in the drawing, adjacent wire hooks 18*a* may face in opposite directions. It is contemplated that the insulation module 12** will include a unit of fiber preferably having dimensions as depicted, for best ease of handling together with enhanced coverage. That is, the unit will preferably be an elongated fiber unit of a thickness substantially less than its height, typically of thickness of only 20–60 percent of the height, and have a length substantially greater than its height, e.g., five to twenty times greater or more. However, other fiber unit configurations can be servicable. Thus, for example, a continuously folded or corrugated unit may have a thickness egual to or exceeding the fiber unit height.

Figure 5:
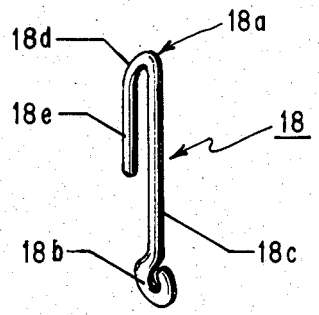
FIG. 5 is a perspective view of a hanger for the insulation module of FIG. 4.

An individual wire hanger 18, such as formed from a unit section of annealed steel, is shown more particularly in FIG. 5. The hanger 18 has an upright hook-shaped head or hook **18*a* composed of a curved bridging portion 18*d* and a hook end element 18*e*. At the opposite end from the hook 18*a*, the hanger 18 has an eye 18*b*. This eye 18*b* is generally circular in structure, but may only be semicircular, e.g., for later closing. Between the eye 18*b* and the hook 18*a* is a mid-section 18*c*. The plane of the eye 18*b* is at a 90 degree angle to the plane of the hook 18*a*, which angle can best be viewed by reference to FIG. 1. This angle being at least substantially 90 degrees provides for the engagement by the eye 18*b* with a fiber insulation module reinforcing rod, not shown. Then the hook 18*a* can move in the plane of the eye 18*b* along a support, not shown, as pressure is applied. Typically, the radius of the eye 18*b* and the hook 18*a* can be identical. Furthermore, the hook end 18*e* may depend back from the bridging portion 18*d* approximately half the length of the mid-section 18*c*. All of the hangers 18 for use in an individual module will most always be of the same size and shape, although such need not be so, e.g., some hangers 18 may have a fully closed eye 18*b*** while others may be open for subseguent welding closure, as will be discussed further hereinbelow.

Figure 6:
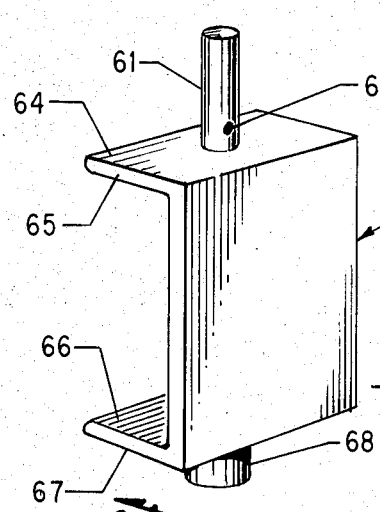
FIG. 6 is a perspective view of a support leg for a vessel cover.

A support leg as depicted in FIG. 6 has an upper post 61 having a hole 62 therethrough near the base. At its base, the post 61 is fixed, as by welding, to a frame member 63, shown as a channel section, at the upper surface 64 of the top flange 65 of the section 63. From the bottom flange 66 of the channel section 63, and at the bottom surface 67 thereof, there depends a collar 68. The center line of the collar 68 is in vertical alignment with the center line of the upper post 61. In use, and referring now to FIG. 6 taken with FIG. 3, the upper post 61 of the support leg is inserted through suitably sized apertures 28 of the positioning plates 27 in front of the compression plate 16. When in place, the hole 62 in the support leg upper post 61 will be positioned above the upper surface of the lower positioning plate 27. By inserting a locking pin, not shown, in the hole 62, the support leg will be retained from falling. In this position, the support leg channel section 63 will extend below the drape of the cover blankets 14 whereby, at rest, the depending collar 68 will be positioned upon the floor or other similar resting surface and protect the cover blankets 14 from damage. It will be appreciated that suitable apertures for insertion of the upper post 61 may be located in such other assembly elements as, for example, the upper flange of the outer frame member 41 shown in FIG. 2.

Figure 7:
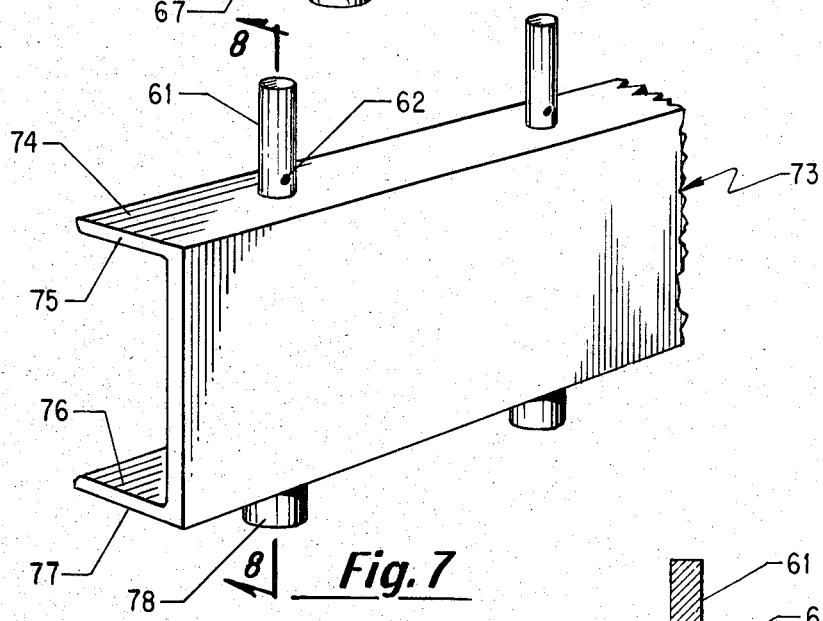
FIG. 7 is a perspective view, in partial section, of an extended support leg unit for a vessel cover.

In FIG. 7 there is shown an extended and interconnected support leg unit. More particularly, upper posts 61 extend upwardly from the upper surface 74 of the top flange 75 of a frame member channel 73 which can be extended, such as along the length of an outer frame member 41. Each post 61 has a hole 62 therethrough for receiving a locking pin, not shown. Below the bottom surface 77 of the bottom flange 76 of the extended channel 73 there depend collars 78. The center line of each collar 78 is in vertical alignment with the center line of a corresponding post 61. By means of the extended channel 73, the total length of a cover, along one side, can be supported by such single support leg unit. Although the channel 73 has been shown as such, it is understood that other suitable frame structure, e.g., girder sections, may be useful.

Figure 8:
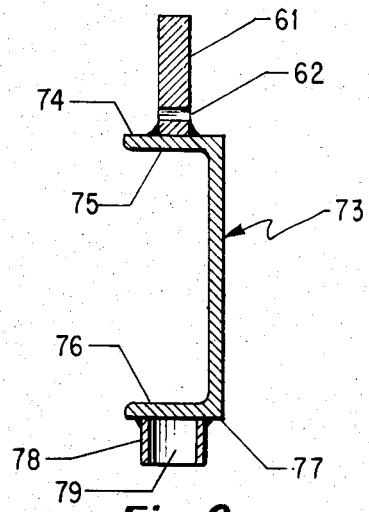
FIG. 8 is a cross-sectional view of a support leg taken along line 8—8 of FIG. 7.

The cross-section for FIG. 8 is taken along line 8—8 of FIG. 7. The support leg upper post 61, with hole 62 therethrough for a locking pin, not shown, is fixed to the upper surface 74 of the top flange 75 of a channel 73. On the lower flange 76, at the bottom surface 77 thereof, there depends a collar 78. In the cross section, the recessed pocket 79 of the collar 78 is exposed. By means of center line alignment between collars 78 and posts 61, as will be noted in FIGS. 6, 7, and 8, covers may be stacked, one upon another, with the collar 78 of an upper cover resting on the post 61 of a lower cover.

As can be seen by referring again to FIG. 1, in assembling the cover assembly the wire hooks **18*a* of a ceramic fiber module can be slipped onto the upright edges 19 at the end splice 26 or the then opened splice sections 26*a*. The splice sections 26*a* can be closed after assembly, such as by welding. After use, and for repair, damaged modules, such as having damaged cover blankets 14, can be readily removed by cutting through the wire hangers 18 thereby facilitating removal of individual cover blankets 14 from their supporting wire hooks 18*a*. Fresh modules can then be inserted, and this will virtually always be done next to the compression plate 16. The wire hangers 18 used during insertion can have straight top sections which are then bent into the wire hooks 18*a* to complete installation. During this operation pressure can be relaxed on the compression plate 16. When the fresh or repaired modules are slipped in, the end splice 26 can be used for such purpose. Occasionally, for some installations, only an end splice 26 is present and it is contemplated that such splices 26, 26*a***, can be altogether eliminated.

The wire hangers 18 will not only provide for movement of the cover blankets 14 along the upright edge 19 of the support members 21 where the blankets 14 are under compression, but also such wire hangers 18 can move upwardly as the cover assembly is positioned in place. By this freedom of movement, the cover blankets 14 can "free float" onto the soaking pit aperture and thereby individual cover blankets 14 can contact the edge of such aperture, compensating even for irregularities in the edge surface. It is preferred that the hooks **18*a*, and eyes 18*b* of the hangers 18, as well as the upright edges 19 of support members 21, be so dimensioned that as the cover blankets 14 free float in position, the hooks 18*a* are not pushed sufficiently upwardly to disengage from the upright edge 19. Although the eyes 18*b* of the hangers 18 generally supportingly engage the support bar 17 in a loose, supportive but unsecured engagement it is preferred that one of the hangers 18 be securely fastened to the support bar 17, e.g., as by welding of the eye 18*b* thereto. Where the eye 18*b* is open, it may be closed around the bar 17 and welded, or where sizing relationships do not permit this, a semicircular eye 18*b* or the like can be welded to the bar 17 and the weld continued around the bar 17 to "close" the eye. It is most advantageous that only one such hanger 18 be so affixed, and the others be in loose, supportive engagement, to permit any heat induced change in the support bar 17, such as swelling or other change in shape, to be accomplished without restriction or hindrance by the hangers 18. On the other hand, a hanger 18 that is firmly affixed can prevent the bar 17 from undesirable movement, such as might accompany vibrations induced in transportation of the cover or in its use. Preferably, the hanger 18 that is securely fastened is at least substantially centrally located in an insulation module. In addition to such fastened hanger 18, the bar 17 may preferably be ridged to assist in firm bar 17 and hanger 18 contact, for example such firm contact for the secured hanger 18 even if the secured eye 18*b* of such hanger 18 works loose, e.g., by the breaking of a weld of the secured eye 18*b***.

Assisting in the overall efficiency and economy of the covering, such as a soaking pit aperture, in addition to the free floating of the cover blankets 14 is the open framework support structure of the frame assembly. Such structure, although firm, nevertheless permits slight twisting and flexing of the overall frame assembly. It can be appreciated that the number of stiffeners 22, and spacing between individual stiffeners 22, as well as similar considerations for the support members 21, can be adjusted to accommodate the degree of the twisting and flexing for the open structured frame assembly. It will also be appreciated that the open structure frame assembly will not substantially entrap heat, there advantageously being no solid lid or cap or similar plate-like cover structure for the lightweight, readily repairable cover.

Although it need not be the case, it is desirable for thread maintenance, that the weight of the compression plate 16 as well as its positioning, be supported and maintained by the guide pins 35. However, the guide pins 35 can be removed and the compression plate 16 supported and positioned by the support legs 32 and top support bar 33. Other structure is also contemplated for the threaded rods 42, e.g., they can be replaced by spring loaded rods. On these rods 42, collars 43 and turn plate 44 can be eliminated. Pry bars or portable jacks can then be used to obtain compression, the compression plate 26 locked in place, and the compression released. With the arrangement using the threaded rods 42, they need only abut against the compression plate 16 and be positioned within the collars 43 on the compression plate 16. Each foot 48 of each adjustment element can be useful in providing for the drape of the cover blankets 14 to project below not only the frame member 41 but also such feet 48. They can also be adjusted to compensate for irregularities in the edge around the soaking pit aperture. But such adjustment elements may be eliminated, especially where flat surfaces permit. Moreover, the compression plate 16 can have flexibility to compress the cover blankets 14 to a greater distance at their center, rather than at their generally cooler edges, and thus "bow" the plate 16 at its center. Alternatively, the plate 16 can be segmented to allow for varying pressure adjustment along the plate 16.

A variety of ceramic fiber insulation filler structures may be employed. For example, in addition to being U-shaped as shown, they can take other shapes, e.g., S-shaped or W shaped. Also, the wire hangers 18 on each upright edge 19 can be projecting from alternate folds, as shown in the FIG. 1. Or, they can all be on one edge only. With the FIG. 1 arrangements, an individual fold of a cover blanket 14 may contain a wire hanger 18 at one upright edge 19 or the other of each support member 21, but they need not be at both of the edges 19.

It is to be understood that the compression plate 16, end splice 26, locking pins 29 and so forth as depicted in the FIG. 2 can be present in association with each of the pair of frame members 41. Hence, both of the cover end assemblies at the ends of the outer frame members 41 may be identical. This need not, however, be the case. Thus, for example, one frame member 41 may simply have spaced inwardly apart from the frame member 41 a fixed plate whereby compression is exerted only with reference to the compression plate 16 assembly adjacent the other, opposing frame member 41. Moreover, even where the same compression plate 16 assemblies are used in conjunction with each frame member 41, compression may be exerted only from one end, whereby the gap between a compression plate 16 and its adjacent frame member 41 may be of extended magnitude, e.g., 30 centimeters or more, whereas at the opposite frame member 41, such gap may be considerably less, e.g., 15 centimeters or less.

Each of the frame members 41, support members 21 and stiffeners 22 can be a rolled channel or similar metal section. Moreover, the metal mesh cover 23 can be of other covering grid material, or such cover need not be used. For providing that the cover 23 be readily removable and thus facilitate ease of repair, the cover 23 may simply rest on the stiffeners 22. For enhanced ease of maintenance and repair, the cover 23 may be in two sections, one placed near each frame member 41, with a substantial opening left between the sections.

Where a heat shield 49 is employed, and such can be an optional feature, it will be affixed to the frame member 41 at the end of the cover assembly which will be nearest the soaking pit when the assembly has been removed from the pit. Suitable materials of construction for the heat shield 49 include ceramic fiber insulation material. Also, the frame members 41, support members 21 and stiffeners 22 can be suitably treated, e.g., painted with a heat reflecting paint.

Referring again to FIG. 2, it will be seen that as the cover assembly is being lowered over a soaking pit, typically by means of a crane hooked to a cover assembly lifting bale, not shown, as the cover blankets 14 are coming to rest around the edge of the soaking pit, such blankets 14 will be free to move upwardly. This movement will cause upward movement of the wire hooks 18*a* along the upright edges 19. As the cover assembly is being set into place, the feet 48 of the elevation adjustment assemblies will likewise be coming to rest in the floor area adjacent the edge of the soaking pit after the cover blankets 14 have initially engaged the edge of the soaking pit. Upon placement of the cover assembly over the soaking pit aperture, the crane hook can be disengaged from the lifting bale, not shown.

Generally, the frame members 41, support members 21 and stiffeners 22 are metal members which are welded together. The hangers 18 may be annealed steel or hardened steel, e.g., annealed wire that is post formed. Metal members might be formed from heat resistant alloy or stainless steel if a corrosive environment will be encountered. All other members, other than the cover blankets and heat shield 49 are preferably likewise metallic. Moreover, as can be appreciated especially by reference to FIGS. 1 and 2, the frame members 41, support members 21 and stiffeners 22 provide an open framework, e.g., a lattice type framework. Thus, girders, channels, beams and rods are most often found useful. Cover members are likewise preferably foraminous metal mesh covers which are readily removable. Such preferred open framework can lead to ease of reconstruction and repair. The cold face of the blankets is thus preferably free from solid or imperforate base plates, top plates and similar plate-type structure.

We claim:

1. A ceramic fiber insulation module adapted for repairing a shrinkage compensating insulation cover structure having a support frame supporting a matrix of discrete, folded ceramic fiber insulation units in form-stable condition, with said insulation being under externally applied compression while being linked, by means of insulation support means, in upwardly moveable as well as at least substantially swinging engagement with said support frame, said insulation module comprising:

at least one unit of folded ceramic fiber insulation in form-stable condition;

at least one support element in interengagement with said folded fiber unit within a fold thereof;

first linking means securely fastened to said support element; and second linking means supportingly engaging said support element without being securely fastened thereto;

wherein said first and second linking means protrude directly from said support element beyond the ceramic fiber and terminate therebeyond in a head configured for said moveable engagement with said support frame.

2. The insulation module of claim 1, wherein said ceramic fiber insulation unit is an S-shaped, W-shaped or U-shaped unit.

3. The insulation module of claim 2, wherein said ceramic fiber insulation unit is interengaged with adjacent units.

4. The insulation module of claim 1, wherein said support element comprises a rod nestled in an insulation unit fold at a bridging section thereof.

5. The insulation module of claim 4, wherein said support element is a ridged rod.

6. The insulation module of claim 1, wherein said first linking means is welded to said support element.

7. The insulation module of claim 1, wherein said second linking means has an eye loosely encircling said support element.

8. The insulation module of claim 1 wherein said first and second linking means each have a hook-shaped head configured for sliding engagement with said support frame in a direction transverse to the plane of the fold of said ceramic fiber insulation unit.

9. The insulation module of claim 1 wherein said first and second linking means are identical in shape and size.

10. The insulation module of claim 1, wherein said first and second linking means each consist of a hanger having an eye and an opposite, hook-shaped head, with the plane of the hook-shaped head being positioned at least substantially 90° to the plane of the eye.

11. The insulation module of claim 10, wherein said eye has a radius at least substantially the same as the radius of the hook-shaped head.

12. The insulation module of claim 1, wherein said module is an elongated module which includes a fiber unit having a unit thickness substantially less than its height, while having a fiber unit length substantially greater than its height.

* * * * *